US009721693B2

(12) United States Patent
Handtrack et al.

(10) Patent No.: US 9,721,693 B2
(45) Date of Patent: Aug. 1, 2017

(54) COLLIMATOR FOR X-RAY, GAMMA, OR PARTICLE RADIATION

(75) Inventors: Dirk Handtrack, Pflach (DE); Heinrich Kestler, Reutte (AT); Gerhard Leichtfried, Reutte (AT)

(73) Assignee: Plansee SE, Reutte (AT)

( * ) Notice: Subject to any disclaimer, the term of this patent is extended or adjusted under 35 U.S.C. 154(b) by 1063 days.

(21) Appl. No.: 13/878,267

(22) PCT Filed: Oct. 4, 2011

(86) PCT No.: PCT/AT2011/000414
§ 371 (c)(1),
(2), (4) Date: May 15, 2013

(87) PCT Pub. No.: WO2012/045106
PCT Pub. Date: Apr. 12, 2012

(65) Prior Publication Data

US 2013/0235981 A1 Sep. 12, 2013

(30) Foreign Application Priority Data

Oct. 7, 2010 (AT) ..... 619/2010

(51) Int. Cl.
*G21K 1/02* (2006.01)
*B22F 3/20* (2006.01)
(Continued)

(52) U.S. Cl.
CPC ..... *G21K 1/02* (2013.01); *B22F 3/20* (2013.01); *B22F 3/24* (2013.01); *B22F 5/00* (2013.01);
(Continued)

(58) Field of Classification Search
CPC ..... G21K 1/02; G21K 1/025
See application file for complete search history.

(56) References Cited

U.S. PATENT DOCUMENTS 4,801,330 A 1/1989 Bose et al.
5,462,576 A * 10/1995 Stuitje ..... C22C 27/04 148/668
(Continued)

FOREIGN PATENT DOCUMENTS

JP S5341087 B1 10/1978
JP S63238600 A 10/1988
(Continued)

OTHER PUBLICATIONS

Plansee GMBH, "Densimet und Inermet Wolframlegierungen", Apr. 8, 2009, pp. 1-16, XP007908150, Lechbruch, Germany.
(Continued)

*Primary Examiner* — Glen Kao
*Assistant Examiner* — Chih-Cheng Kao
(74) *Attorney, Agent, or Firm* — Laurence A. Greenberg; Werner H. Stemer; Ralph E. Locher

(57) ABSTRACT

A collimator for x-ray, gamma, or particle radiation has a plurality of collimator elements made of a tungsten-containing material to reduce scattered radiation. At least one collimator element consists of a tungsten alloy having a tungsten content of 72 to 98 wt.-%, which contains 1 to 14 wt.-% of at least one metal of the group Mo, Ta, Nb and 1 to 14 wt.-% of at least one metal of the group Fe, Ni, Co, Cu. The collimator also has very homogeneous absorption behavior at very thin wall thicknesses of the collimator elements.

17 Claims, 1 Drawing Sheet

(51) Int. Cl.

| | |
|---|---|
| ***B22F 3/24*** | (2006.01) |
| ***C22C 27/00*** | (2006.01) |
| ***C22C 27/04*** | (2006.01) |
| ***C22C 1/04*** | (2006.01) |
| ***B22F 5/00*** | (2006.01) |

(52) U.S. Cl.
CPC ..... *C22C 1/045* (2013.01); *C22C 27/00* (2013.01); *C22C 27/04* (2013.01); *G21K 1/025* (2013.01); *B22F 2998/10* (2013.01)

(56) References Cited

U.S. PATENT DOCUMENTS

| | | | | |
|---|---|---|---|---|
| 8,418,348 | B2 | 4/2013 | Tonami | |
| 2005/0084072 | A1 | 4/2005 | Pinchot | |
| 2008/0101542 | A1* | 5/2008 | Ikhlef | G21K 1/025 378/147 |
| 2010/0006781 | A1 | 1/2010 | Tonami | |

FOREIGN PATENT DOCUMENTS

| | | | |
|---|---|---|---|
| JP | H01301807 | A | 12/1989 |
| JP | H059641 | A | 1/1993 |
| JP | H05309088 | A | 11/1993 |
| JP | H06100973 | A | 4/1994 |
| JP | H07166287 | A | 6/1995 |
| JP | H0971828 | A | 3/1997 |
| JP | H09257996 | A | 10/1997 |
| JP | H1136003 | A | 2/1999 |
| JP | H11350060 | A | 12/1999 |
| JP | 2002030372 | A | 1/2002 |
| JP | 2003287590 | A | 10/2003 |
| JP | 2004177250 | A | 6/2004 |
| JP | 2006505688 | A | 2/2006 |
| JP | 2006-258765 | A | 9/2006 |
| JP | 2008063985 | A | 3/2008 |
| JP | 2010085211 | A | 4/2010 |
| JP | 2010190802 | A | 9/2010 |
| WO | 2010010607 | A1 | 1/2010 |

OTHER PUBLICATIONS

Plansee GMBH, "Wolfram Werkstoffeigenschaften und Anwendugen", Sep. 2, 2000, pp. 1-36, Lechbruch, Germany.

Plansee GMBH, "Densimet D2M", Jan. 19, 2012, XP55016936, Lechbruch, Germany.

* cited by examiner

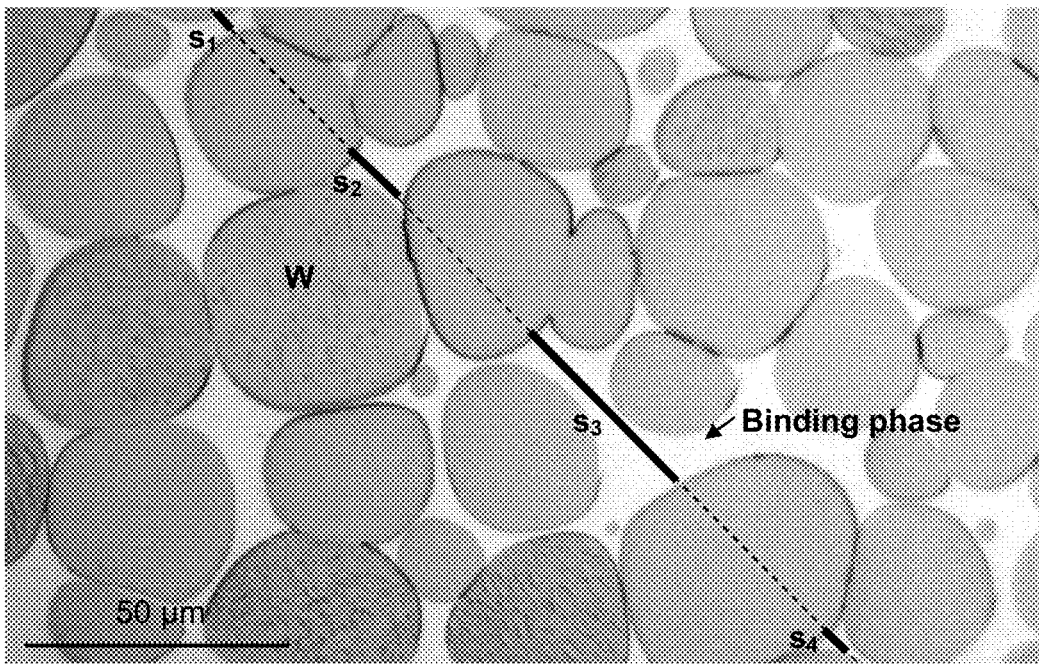
s1
s2
W
s3
Binding phase
50 µm
s4

COLLIMATOR FOR X-RAY, GAMMA, OR PARTICLE RADIATION

BACKGROUND OF THE INVENTION

Field of the Invention

The invention relates to a collimator for x-ray, gamma, or particle radiation, which has a plurality of collimator elements made of a tungsten-containing material to reduce the scattered radiation, a collimator element, and a method for producing a collimator element.

A collimator is a device for producing a parallel beam path, as an infinitely distant beam source would produce, and is used, for example, in imaging by an x-ray device, for example, a computer tomography device. The collimator is arranged over the scintillator array of the detector element and has the effect that only x-ray radiation of a specific spatial direction reaches the scintillator array. The collimator has a plurality of collimator elements, which are arranged at defined intervals to one another and fixed, for reducing the scattered radiation. The scattered radiation which is incident at an angle is absorbed by the collimator elements. Only radiation in the radiation main direction thus enters the radiation detector module.

If the collimator elements are plate-like, they are referred to as collimator plates. The plate thickness is typically approximately 100 μm.

Collimator elements are typically produced from tungsten-based or molybdenum-based materials. Because of the high density and the high atomic number, tungsten displays the best absorption behavior with respect to x-ray, gamma, and particle radiation. The high strength and the high modulus of elasticity ensure good stability. The complex rolling process which is required for producing thin collimator elements is disadvantageous if tungsten is used.

Tungsten alloys which contain tungsten and a metallic binding phase having a lower melting point are referred to as heavy metal. Tungsten is the main component of the alloy, wherein the tungsten content is typically 85 to 98 wt.-%. The binding phase typically consists of Ni/Fe or Ni/Cu.

Heavy metal alloys are produced by powder-metallurgy techniques. The alloy components are mixed; the powder thus produced is compressed and compacted by liquid phase sintering. During the sintering, tungsten dissolves into the binding phase and tungsten separates out of the binding phase. Heavy metal has been used for shielding apparatuses for decades. However, in the case of wall thicknesses less than 200 μm, the problem exists that the binding phase fraction differs locally in magnitude in the direction of the incident radiation over the wall thickness of the shielding apparatus. Since the absorption capacity of the binding phase is significantly lower in comparison to tungsten, this has the result that the absorption capacity also differs. It is fundamentally possible to produce a more favorable microstructure for the shielding behavior through a rolling process following the sintering, which microstructure has tungsten grains stretched in the rolling direction. However, this is linked to significantly higher manufacturing costs, whereby the plates thus produced have no advantages in comparison to collimator elements made of pure tungsten.

BRIEF SUMMARY OF THE INVENTION

It is therefore the object of the present invention to provide a collimator for x-ray, gamma, or particle radiation, which contains collimator elements which have a high and uniform shielding effect and may be produced in a simple manner.

The object is achieved by a collimator as claimed, a collimator element as claimed, and a method for producing a collimator element as claimed. Advantageous embodiments are specified in the dependent claims.

Collimator elements have a high absorption capacity, which is homogeneous over the volume even at low wall thicknesses, if they are manufactured from a tungsten alloy having a tungsten content of 72 to 98 wt.-%, which contains 1 to 14 wt.-% of at least one metal of the group Mo, Ta, Nb and 1 to 14 wt.-% of at least one metal of the group Fe, Ni, Co, Cu. For clarification, it is to be noted that if two or more metals of one group are contained in the alloy, the specified content represents the respective total content. The tungsten alloy can contain, in addition to the listed alloy elements and contaminants, further elements, which are soluble in the binding phase, having a total content <5 wt.-%, without the effect according to the invention thus being impaired. The tungsten alloy preferably consists of 1 to 14 wt.-% of at least one metal of the group Mo, Ta, Nb; 1 to 14 wt.-% of at least one metal of the group Fe, Ni, Co, Cu, and the remainder tungsten. The total content of Mo, Ta, Nb, Fe, Ni, Co, and Cu is therefore preferably 2 to 28 wt.-%.

The collimator element preferably has a density of >95% of the theoretical density. The best results can be achieved if the density is >99% of the theoretical density.

If the tungsten content is less than 72 wt.-%, a sufficient shielding effect is not achieved. If the tungsten content is greater than 98%, sufficient sintering density is not achieved by means of liquid phase sintering, which has a disadvantageous effect on the absorption capacity and the mechanical properties.

If the total content of Mo, Ta, and/or Nb is less than 1 wt.-%, sufficient homogeneity of the shielding effect is not achieved. If the total content of Mo, Ta, and/or Nb is greater than 14 wt.-%, sufficient sintering density is not achieved. The Mo, Ta, and/or Nb total content is preferably 2 to 8 wt.-%. The best results could be achieved with molybdenum at an alloy content of 2 to 8 wt.-%.

If the total content of Fe, Ni, Co, and/or Cu is less than 1 wt.-%, a sufficient sintering density is not achieved. If the total content of Fe, Ni, Co, and/or Cu is greater than 14 wt.-%, the absorption capacity is excessively low. The preferred total content of Fe, Ni, Co, and/or Cu is 2 to 9 wt.-%, wherein the best results could be achieved with 2 to 9 wt.-% Fe and/or Ni.

The collimator element according to the invention preferably has tungsten grains having a mean grain aspect ratio <1.5. The grain aspect ratio is determined by first producing a metallographic microsection. The maximum grain diameter of a tungsten grain in the direction parallel to the surface of the collimator element is then ascertained. This measurement is repeated on at least 20 further tungsten grains. As the next step, the maximum grain diameter in a direction perpendicular to the surface of the collimator element is determined on a tungsten grain. This step is again repeated at least 20 times. The mean grain diameter in the direction parallel to the surface and in the direction perpendicular to the surface of the collimator element is then determined.

The mean grain aspect ratio, which is also designated as the GAR, is calculated by dividing the mean grain diameter in the direction parallel to the surface by the mean grain diameter in the direction perpendicular to the surface. The mean grain aspect ratio is preferably <1.2. A method according to the invention allows the cost-effective production of a tungsten alloy having a mean grain aspect ratio of approximately 1. I.e., the tungsten grains have a spherical shape. Grains with approximately spherical shape are also designated as globular grains. The tungsten alloy then has tungsten grains having globular shape if the collimator element is only manufactured by sintering. A low grain aspect ratio of up to 1.2 is achieved if the collimator element is subjected to a rolling process for calibration purposes. Forming processes which result in a grain aspect ratio of >1.5 are linked to higher manufacturing costs.

The thickness of the collimator element is preferably 50 to 250 μm. At less than 50 μm, both the stiffness and also the shielding effect are inadequate. At greater than 250 μm, the volume is excessively large. The thickness is preferably 50 to 150 μm. The preferred embodiment is that of a collimator plate.

The collimator elements according to the invention are preferably used if the requirements for the uniformity of the absorption capacity are very high. This applies especially to computer tomography. The collimator according to the invention is therefore preferably part of the imaging unit of a computer tomography device.

The collimator preferably has a mean number of tungsten grains over the thickness of the collimator element of >5. The grains are arranged interleaved. It is ensured by the high number of the tungsten grains and their interleaved arrangement that the radiation is uniformly absorbed by tungsten components.

The mean number of tungsten grains over the thickness of the collimator element is determined as follows. In a metallographic microsection, a line extending perpendicularly to the surface is drawn from one surface to the other surface of the collimator element. As the next step, the number of tungsten grains which are at least regionally intersected by the line is determined. This procedure is repeated at least 20 times and the mean value is determined. The number of tungsten grains over the thickness of the collimator element is preferably >10, particularly preferably >20.

A preferred cost-effective production method for a collimator element is performed by shaping a plasticized powder compound or a slurry, for example, by foil extrusion or tape casting.

Firstly, a powder compound, which is also designated as a molding compound, is produced. The powder compound preferably comprises 45 to 65 vol.-% metal powder, 35 to 55 vol.-% thermoplastic binder, and optionally up to 5 vol.-% dispersing agent and/or other auxiliary agents. According to the method-related requirement profile, the possibility therefore results of a formula-related embodiment of the respective powder compound. Thermoplastic binders which comprise a polymer and at least one plasticizer have proven to be particularly advantageous.

In the case of foil extrusion, particularly favorable results may be achieved with nitrogenous polymers, for example, polyurethane and polyamide. To set appropriate melt viscosities and ensure sufficient room temperature strength, mixtures made of liquid and solid plasticizers are preferably added. Fatty acids, esters of the fatty acids, or fatty alcohols have proven themselves as plasticizers. A preferred volume ratio of polymer to plasticizer is 1:1 to 1:6. The metal powder contains 72 to 98 wt.-% W, 1 to 14 wt.-% of at least one metal of the group Mo, Ta, Nb, and 1 to 14 wt.-% of at least one metal of the group Fe, Ni, Co, Cu. The metal powder preferably consists of 1 to 14 wt.-% of at least one metal of the group Mo, Ta, Nb; 1 to 14 wt.-% of at least one metal of the group Fe, Ni, Co, Cu, and the remainder tungsten. In a next step, the molding compound is plasticized. The plasticizing can be performed, for example, in an extruder at temperatures between 60° C. and the decomposition temperature of the respective binder. A green sheet is then produced by shaping of the plasticized powder compound. Extrusion through a slot die has proven to be particularly advantageous in this case. The green sheet can further be subjected to a smoothing procedure. The smoothing procedure can be an equalization table, in which depressions and protrusions of the green are equalized, without a thickness reduction occurring. The thickness reduction per smoothing procedure can also be up to 70%, however, without the green sheet being damaged.

The debinding of the green sheet is performed as the next step. The debinding can be performed by typical chemical and/or thermal methods. Thermal debinding can also be an integral process component of the sintering.

The sintering is performed at least above the liquidus temperature of the binding metal phase. The liquidus temperature is preferably >1100° C. for the binding metal alloys according to the invention. The liquidus temperature can be inferred from the known phase diagrams. The preferred maximum sintering temperature is 1500° C. The preferred temperature range is therefore between 1100 and 1500° C.

After the sintering, the sheet thus produced can be subjected to a rolling process, wherein the degree of forming is preferably less than 20% (degree of forming=(starting thickness minus final thickness)/starting thickness)×100). The further processing and finishing of the sintered sheet or the rolled sintered sheet is performed by typical processing methods, preferably by stamping, eroding, or pickling.

The production of the green sheet can also be performed by tape casting, for example. In this case, powder, a binder, and a solvent are mixed with the powder of the alloys according to the invention to form a slurry. Water-based binder systems are preferably used, for example, emulsion binders, which represent stable suspensions of water-insoluble submicron polymer particles (for example, acrylic resin, polyurethane). Water-soluble polyvinyl alcohols or solvent-based binder systems, for example, acrylic resin dissolved in methyl ethyl ketone, are also suitable.

If needed, the air enclosed in the slurry is removed by an antifoam. The slurry is applied by means of a doctor blade to a carrier foil to produce a sheet. The sheet is dried in a further processing step by heating in a drying chamber. The further finishing is performed according to the method steps specified for foil extrusion.

EXAMPLE

Brief Description of the Several Views of the Drawing

FIG. 1: light microscopy picture of sample number 2 according to table 1, which schematically shows the determination of the homogeneity factor HF.

DESCRIPTION OF THE INVENTION

The invention is described as an example hereafter.

The following powders were used for the experiments:

tungsten (grain size according to Fisher 4 μm),
nickel (grain size according to Fisher 5 μm),
iron (grain size according to Fisher 6 μm),
molybdenum (grain size according to Fisher 4 μm),
tantalum (grain size according to Fisher 7 μm),
niobium (grain size according to Fisher 7 μm),
cobalt (grain size according to Fisher 5 μm),
copper (grain size according to Fisher 6.5 μm).

Firstly powder mixtures were produced by mixing in a diffusion mixer in the compositions as listed in table 1. The respective powder batches were admixed with polyamide and plasticizer, wherein the powder fraction was respectively 53 vol.-% and the binder fraction was respectively 47 vol.-%.

The binder had the following composition:

30 wt.-% polyamide, 44 wt.-% aromatic carboxylic acid ester of an aliphatic alcohol having a chain length of C8, 26 wt.-% fatty acid having a chain length of C16 to C22.

Powder and binder were mixed in a kneading assembly at 130° C. for 20 min. The powder compound was extruded at 110° C., cooled, and made into a molding compound in granule form having approximately 3 to 4 mm particle diameter. The molding compound was melted by means of a single-screw extruder at barrel zone temperatures of 80° C. to 130° C. and extruded through a slot die. The green body thus produced was smoothed in a smoothing rolling mill with a thickness reduction of 40% and cooled to room temperature. In the next process step, the green body was subjected to chemical partial debinding in acetone at 42° C.

The remaining binder was removed pyrolytically/thermally by heating (heating rate 10° C./minute) and holding for 30 min. at 600° C. The debindered green body was sintered for 15 min. at a temperature 20° C. above the respective liquidus temperature, as can be inferred from the known phase diagrams. The sheet thickness after the sintering was 100 μm. The density was determined by the buoyancy method. The values are again listed in table 1.

A metallographic microsection was then produced and analyzed by quantitative metallography. A line was drawn at 45° C. to the surface and the total route length for the binding phase (SSL) was determined. SSL is to be understood as the sum of all individual route lengths $s_1$ to $s_n$, as shown in FIG. 1.

$$SSL = \sum_{1}^{n} s$$

This measurement was repeated 20 times, the mean total route lengths $\overline{SSL}$ (mean value of the 20 measurements) were determined for the binding phase and the total maximum route length $SSL_{MAX}$ (greatest measured value of the 20 measurements) was determined for the binding phase.

The homogeneity factor HF was then ascertained, where:

$$HF = \frac{SSL_{MAX} - \overline{SSL}}{\overline{SSL}}$$

The homogeneity of the beam absorption was classified as follows:

HF≤0.25 (high homogeneity=HH)

0.25<HF≤0.5 (moderate homogeneity=MH)

HF>0.5 (low homogeneity=LH).

The results are listed in table 1.

TABLE 1

| No. | W (wt.-%) | Mo (wt.-%) | Ta (wt.-%) | Nb (wt.-%) | Ni (wt.-%) | Fe (wt.-%) | Co (wt.-%) | Cu (wt.-%) | Relative density | HF |
|---|---|---|---|---|---|---|---|---|---|---|
| 1 NEG | 92.5 | | | | 7.5 | | | | 100 | LH |
| 2 NEG | 92.5 | | | | 5 | 2.5 | | | 99.8 | LH |
| 3 NEG | 92.5 | | | | 5 | | | 2.5 | 94.7 | LH |
| 4 NEG | 92.5 | | | | 4.5 | 2.5 | 0.5 | | 99.5 | LH |
| 5 NEG | 92.5 | | | | 4.5 | 2.5 | 0.5 | | 99.8 | LH |
| 6 NEG | 92.5 | | | | 4.5 | 2 | 1 | | 99.1 | LH |
| 7 NEG | 92.5 | 0.5 | | | 4.5 | 2.5 | | | 99.7 | LH |
| 8 EG | 90 | 4 | | | 4 | 2 | | | 98 | HH |
| 9 EG | 92.5 | 3 | | | 3 | 1.5 | | | 100 | HH |
| 10 EG | 92.5 | 1.5 | | | 4 | 2 | | | 100 | MH |
| 11 EG | 80 | 11 | | | 6 | 3 | | | 97.0 | MH |
| 12 EG | 95 | 3 | | | 2 | | | | 97.5 | MH |
| 13 EG | 88 | | 6 | | 4 | 2 | | | 97.0 | MH |
| 14 EG | 92.5 | 3 | | | 4 | | 0.5 | | 98.1 | HH |
| 15 EG | 92.5 | 3 | | | 4 | | | 0.5 | 96.2 | HH |
| 16 EG | 77 | 14 | | | 6 | 3 | | | 95.0 | HH |
| 17 EG | 92 | | 2 | | 4 | 2 | | | 97.8 | MH |
| 18 EG | 90 | | | 4 | 4 | 2 | | | 98 | MH |
| 19 EG | 92.5 | | | 1.5 | 4 | 2 | | | 100 | MH |

TABLE 1-continued

| No. | W (wt.-%) | Mo (wt.-%) | Ta (wt.-%) | Nb (wt.-%) | Ni (wt.-%) | Fe (wt.-%) | Co (wt.-%) | Cu (wt.-%) | Relative density | HF |
|---|---|---|---|---|---|---|---|---|---|---|
| 20 EG | 90 | 3 | 1 | | 4 | 2 | | | 97.8 | HH |

NEG . . . Not according to the invention;
EG . . . According to the invention;
HH: HF ≤ 0.25 (high homogeneity)
MH: 0.25 < HF ≤ 0.5 (moderate homogeneity)
LH: HF > 0.5 (low homogeneity)

The invention claimed is:

1. A collimator for x-ray, gamma, or particle radiation, the collimator comprising:

a plurality of collimator elements made of a tungsten-containing material and configured to reduce scattered radiation;

at least one of said collimator elements being formed of a tungsten alloy having a tungsten content of 72 to 98 wt.-%, said tungsten alloy containing 1 to 14 wt.-% of at least one metal selected from the group consisting of Mo, Ta, and Nb, and 1 to 14 wt.-% of at least one metal selected from the group consisting of Fe, Ni, Co, and Cu; and wherein a mean number of tungsten grains over a thickness of said at least one collimator element is greater than 5, a thickness of said at least one collimator element is 50 to 250 μm, and a homogeneity factor HF is ≤0.5.

2. The collimator according to claim 1, wherein said tungsten alloy consists of 1 to 14 wt.-% of at least one metal selected from the group consisting of Mo, Ta and Nb; 1 to 14 wt.-% of at least one metal selected from the group consisting of Fe, Ni, Co and Cu, and a remainder of tungsten.

3. The collimator according to claim 1, wherein said tungsten alloy contains 2 to 8 wt.-% of at least one metal selected from the group consisting of Mo, Ta and Nb and 2 to 9 wt.-% of at least one metal selected from the group consisting of Fe, Ni, Co and Cu.

4. The collimator according to claim 3, wherein said tungsten alloy contains 2 to 8 wt.-% Mo and 2 to 9 wt.-% of at least one metal selected from the group consisting of Fe and Ni.

5. The collimator according to claim 1, wherein said tungsten alloy comprises tungsten grains having a mean grain aspect ratio of less than 1.5.

6. The collimator according to claim 5, wherein said tungsten alloy comprises tungsten grains having a globular form.

7. The collimator according to claim 1, wherein the homogeneity factor HF is ≤0.25.

8. The collimator according to claim 1, wherein the mean number of tungsten grains over the thickness of said at least one collimator element is greater than 10.

9. The collimator according to claim 1, wherein said at least one collimator element is a collimator plate.

10. The collimator according to claim 1, configured to form a part of an imaging unit of a computed tomography device.

11. A collimator element, consisting of a tungsten alloy having a tungsten content of 72 to 98 wt.-%, said tungsten alloy containing 1 to 14 wt.-% of at least one metal selected from the group consisting of Mo, Ta and Nb, and 1 to 14 wt.-% of at least one metal selected from the group consisting of Fe, Ni, Co and Cu; and wherein a mean number of tungsten grains over a thickness of the collimator element is greater than 5, a thickness of the collimator element is 50 to 250 μm, and a homogeneity factor HF is ≤0.5.

12. A method for producing a collimator element according to claim 11, the method which comprises carrying out a foil extrusion process or a tape casting process to thereby produce the collimator element according to claim 11.

13. The method according to claim 12, which comprises the following method steps:

producing a powder compound with:

45 to 65 vol.-% metal powder, the metal powder containing 72 to 98 wt.-% W, 1 to 14 wt.-% of at least one metal selected from the group consisting of Mo, Ta and Nb, and 1 to 14 wt.-% of at least one metal selected from the group consisting of Fe, Ni, Co and Cu; and 35 to 55 vol.-% of a thermoplastic binder;

plasticizing the powder compound to form a plasticized powder compound;

producing a green sheet by shaping the plasticized powder compound;

debindering the green sheet by a chemical and/or thermal process to form an at least partially debindered green sheet;

sintering the at least partially debindered green sheet at a sintering temperature of 1100 to 1500° C. for producing a sintered sheet;

processing the sintered sheet to produce a final form of the collimator element having a mean number of tungsten grains over a thickness of the collimator element greater than 5, a thickness of the collimator element is 50 to 250 μm, and a homogeneity factor HF is ≤0.5.

14. The method according to claim 13, wherein the processing step comprises at least one process selected from the group consisting of pickling, stamping, and eroding.

15. The method according to claim 13, which comprises, prior to debindering the green sheet, smoothing the green sheet.

16. The method according to claim 13, which comprises subjecting the sintered sheet to calibration rolling.

17. The method according to claim 13, wherein the powder compound comprises content of up to 5 vol.-% dispersing agent and/or other auxiliary agents.

* * * * *